US007699125B2

(12) United States Patent
Folk

(10) Patent No.: US 7,699,125 B2
(45) Date of Patent: Apr. 20, 2010

(54) WORM AND COLLAR DRIVE DRILL RIG

(75) Inventor: Robert Folk, Red Deer (CA)

(73) Assignee: Victory Rig Equipment Corporation, Red Deer, Alberta (CA)

( * ) Notice: Subject to any disclaimer, the term of this patent is extended or adjusted under 35 U.S.C. 154(b) by 114 days.

(21) Appl. No.: 11/739,500

(22) Filed: Apr. 24, 2007

(65) Prior Publication Data

US 2007/0246264 A1 Oct. 25, 2007

Related U.S. Application Data

(60) Provisional application No. 60/745,471, filed on Apr. 24, 2006.

(51) Int. Cl.
*E21B 19/08* (2006.01)

(52) U.S. Cl. ..... 175/122; 175/162

(58) Field of Classification Search ..... 175/122, 175/162, 203, 52
See application file for complete search history.

(56) References Cited

U.S. PATENT DOCUMENTS

| | | | | |
|---|---|---|---|---|
| 1,507,294 | A * | 9/1924 | Mercer | 173/188 |
| 3,734,209 | A | 5/1973 | Haisch et al. | |
| 3,734,212 | A | 5/1973 | Perlewitz et al. | |
| 4,022,284 | A * | 5/1977 | Crow | 173/2 |
| 4,041,899 | A * | 8/1977 | Wolfe et al. | 239/752 |
| 5,784,923 | A * | 7/1998 | Kuehnle | 74/465 |
| 6,464,020 | B1 * | 10/2002 | Wills | 175/20 |

* cited by examiner

*Primary Examiner*—Shane Bomar
(74) *Attorney, Agent, or Firm*—Bennett Jones LLP

(57) ABSTRACT

A drilling or service rig includes a worm drive disposed within and rotatably supported within a mast having one open side. The worm drive defines a helical groove, and a collar is disposed on the worm drive and engages the helical groove. Rotation of the worm drive causes movement of the collar upwards or downwards along the worm drive. The collar may support a block and top drive assembly.

12 Claims, 13 Drawing Sheets

TOP VIEW DOUBLE SCREW

SIDE VIEW DOUBLE SCREW

TOP VIEW TRIPLE SCREW

SIDE VIEW TRIPLE SCREW

WORM AND COLLAR DRIVE DRILL RIG

CROSS REFERENCE TO RELATED APPLICATION

This application claims the priority benefit of U.S. Provisional Application No. 60/745,471 filed on Apr. 24, 2006 entitled "Worm and Collar Drive Drill Rig", the contents of which are incorporated herein by reference.

FIELD OF THE INVENTION

The present invention relates to a drilling or service rig having a worm and collar drive.

BACKGROUND

Drilling an oil or gas well involves two main operations: drilling and tripping. To commence the drilling procedure, a drill string terminating with a drill bit is positioned within a drilling rig and rotated such that the drill bit bores into the ground or into the seabed, in the case of offshore drilling, until it reaches a predetermined depth or penetrates a petroleum-bearing geological formation. The components of the drill string such as drill collars and drill pipe are threaded for interconnection. Depending on what type of drive system is being used, the uppermost length of drill pipe in the drill string is connected either to a kelly or to a top drive. As the drill bit advances and the top of the drill string approaches the working platform or drill floor of the drilling rig, additional lengths of drill pipe must be added to the drill string in order to advance the well further into the ground. This is accomplished by temporarily supporting the top of the drill string near the drill floor level (using devices called "slips"), disconnecting the kelly (or the top drive, as the case may be) from the top of the drill string, and then lifting a new section of drill pipe into position using the rig's elevating system and screwing it into the top of the drill string. The kelly (or the top drive) is then reconnected to the drill string, and drilling operations resume until it is again necessary to add drill pipe.

Perhaps the most common and well-known drive means for rotating a drill string is the rotary table, which is a rotating mechanism positioned on the drill floor, and which entails the use of a kelly, referred to previously. The kelly is essentially a heavy, four-sided or six-sided pipe, usually about 42 feet long or 57 feet long for offshore rigs. The rotary table has rotating bushings shaped to accommodate the kelly, plus roller bearings which allow the kelly to slide vertically through the bushings even as the rotary table is rotating. The kelly is suspended from the rig's main hoist, in conjunction with various accessories required for drilling operations (e.g., swivel, pipe elevators). With the kelly connected to the top of the drill string, the hoist lowers the drill string until the lower end of the kelly is positioned within the bushings of the rotary table. The rotary table is then activated, rotating both the kelly and the drill string connected to it, thereby turning the drill bit at the bottom of the drill string and advancing the well to a greater depth. The process of turning the drill bit to advance the hole is referred to as "making hole".

An increasingly common alternative to the rotary table is the top drive unit, which applies rotational drive at the top of the drill string, rather than at the drill floor as in the case of the rotary table. Top drive units are typically driven by either hydraulic or electric power. A significant advantage of the top drive is that a kelly is not required; instead, the drill string is connected directly to the top drive. The top drive is supported by the rig's main hoist, and moves downward along with the drill string as drilling progresses. A rig using a top drive must provide some means for resisting or absorbing the torque generated by the top drive as it rotates the drill string, so that the top drive will be laterally and rotationally stable at all stages of drilling. This is typically accomplished by having the top drive travel along vertical guide rails built into the rig superstructure.

Tripping is a necessary but unproductive part of the overall drilling operation, and involves two basic procedures. The first procedure is extracting drill pipe from the well (referred to in the industry as "pulling out of hole" mode, or "POH"), and the second is replacing drill pipe in the well ("running in hole" mode, or "RIH"). Tripping may be necessary for several reasons, such as for replacement of worn drill bits, for recovery of damaged drill string components, or for installation of well casing.

In POH mode, the kelly (if there is one) is removed temporarily, the drill string is connected to the pipe elevators, and the drill string is then pulled partially out of the hole as far as the hoisting mechanism and geometry of the drilling rig will permit. The drill string is then supported by the slips so that the section or sections of the drill pipe exposed above the drill floor may be disconnected or "broken out" and moved away from the well. The elevators then re-engage the top of the drill string so that more of the drill string may be pulled out of the hole. This process is repeated until the desired portion of the drill string has been extracted. The procedure for RIH mode is essentially the reverse of that for POH mode.

It is well known to use cable-and-winch mechanisms for hoisting and lowering the drill string and casing string during the drilling of gas and oil wells. In such mechanisms, a heavy wire-rope cable (or "drilling line") runs upward from a winch (or "drawworks") mounted at the drill floor level, then is threaded through the sheaves of a "crown block" mounted high in the derrick or mast of the rig, and then down through the sheaves of a "travelling block", which moves vertically with the load being hoisted. The entire weight of the drill string, which can be several hundred tons, is transferred via the travelling block, drilling line, and crown block to the rig's derrick, which accordingly must be designed and built to withstand such loads.

A significant disadvantage of cable-and-winch rigs is that the drilling line will deteriorate eventually, entailing complete removal and replacement. This may have to be done several times during the drilling of a single deep well. Drilling line cable, being commonly as large as two inches in diameter, is expensive, and it is not unusual for a rig to require a drilling line as up to 1,500 feet long. Replacement of the drilling line due to wear accordingly results in a large direct expense. Further, the inspection, servicing, and replacement of drilling line typically results in a considerable loss of drilling time, and a corresponding increase in the overall cost of the drilling operation.

Furthermore, the drawworks, block, drilling line, and crown sheaves are heavy items, and are not conducive to mobile rigs which are increasing in popularity.

There is a need in the art for an improved drill rig which mitigates the disadvantages of the prior art.

SUMMARY OF THE INVENTION

The present invention relates to an improved drilling rig. The invention may also relate to service rigs or other devices intended to bore holes in the earth.

In one aspect, the invention comprises a drilling or service rig comprising:

(a) a rig substructure having a mast base;

(b) a mast having at least one open side;

(c) a worm drive defining a helical groove, disposed within the mast;

(d) at least one collar engaging the worm drive, wherein rotation of the worm drive causes longitudinal movement of the collar along the worm drive;

(e) a top drive assembly attached to the at least one collar and cantilevered from the collar out the open side of the mast; and (f) means for rotating the worm drive.

In one embodiment the collar comprises a plurality of internal rollers for engaging the helical groove of the worm drive. Each roller may comprise a roller head and a roller shaft and is inserted into the collar through a keyhole opening and fastened to the collar. Each keyhole opening may have two narrowed portions, and each keyhole opening is associated with two adjacent rollers. In one embodiment, the mast is rotatable about its longitudinal axis. The mast may also be moveable between a vertical position and a substantially horizontal position and may be fixed in any position there between.

In one embodiment, the drive means comprises an electric motor. The electric motor may be directly coupled to the worm drive, without gear reduction or increase.

In one embodiment, the rig further comprises a pipe tub assembly comprising a pipe tub skid, a pipe tub pivotally engaging the pipe tub skid at one end, a pipe tub stand which slidingly engages the pipe tub skid at one end and the pipe tub at another end, and a winch and pulley assembly for moving the pipe tub stand along the pipe tub skid, thereby moving the pipe tub between a near horizontal position to a substantially vertical position.

In one embodiment, the rig further comprises a brake assembly comprising a brake disk attached to the work drive, and at least one pair of brake calipers operatively engaging the brake disk. In one embodiment, the rig mast includes two or more worm drives and has means for synchronizing the two or more work drives. In one embodiment, there are three mast drives.

In another embodiment, each worm drive actuates two collars and the top drive assembly is attached to both collars.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

The present invention provides for a novel drilling or service rig. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
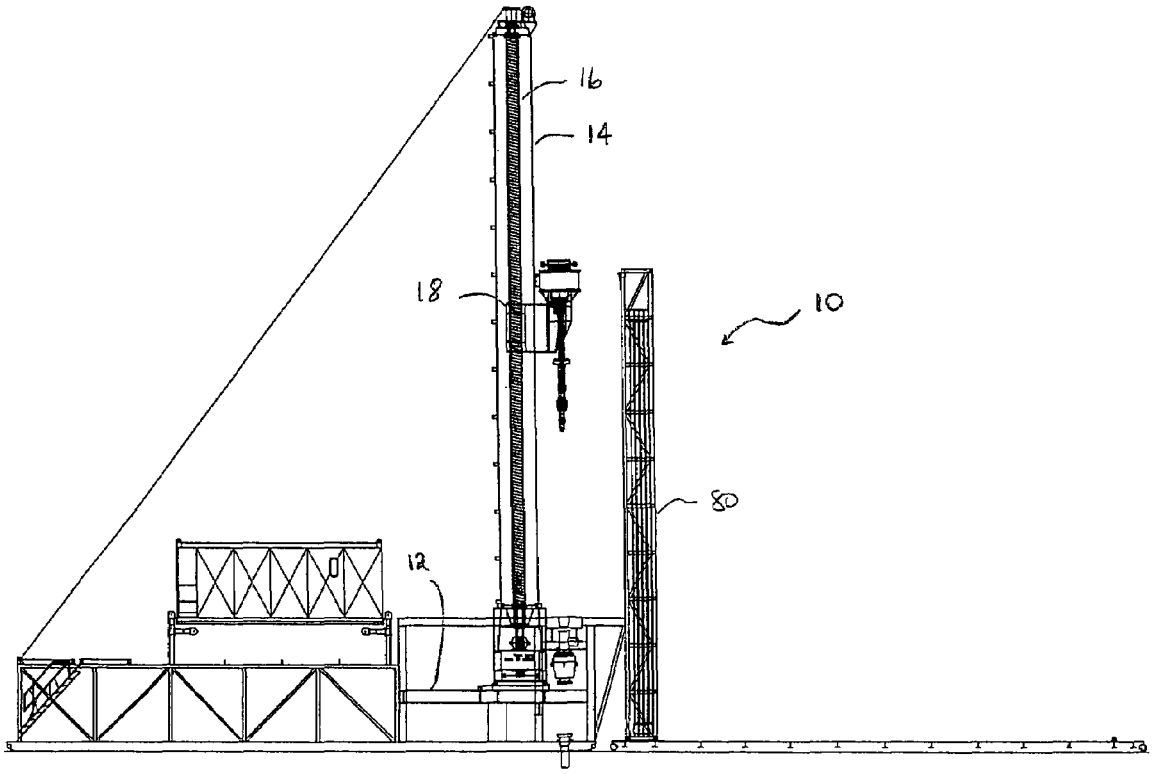
FIG. 1 is a view of one embodiment of the present invention.

In one embodiment, with reference to FIG. 1, a rig (10) of the present invention includes a substructure (12) and a mast (14). The mast (14) includes a worm drive (16) which is a driveshaft having a helical groove cut into its surface. A collar (18) having means for engaging the worm drive (16) is driven longitudinally along the length of the worm drive by rotation of the worm drive. In its simplest form, collar (18) may be a nut having an internal thread complementary to the worm drive helical groove.

Figure 2A:
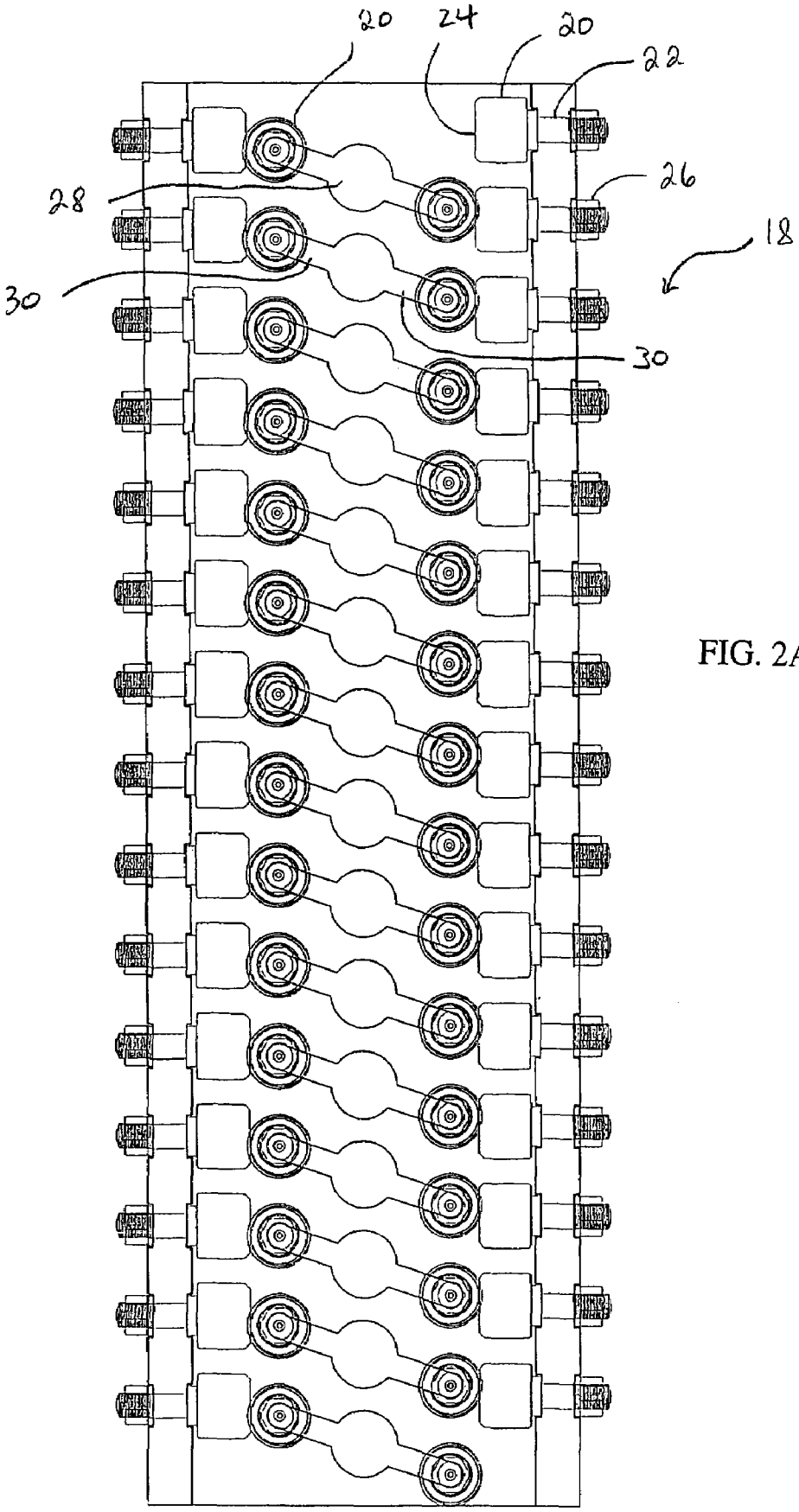
FIG. 2A is a cross-sectional view of a collar and rollers of a preferred embodiment, along line IIA in FIG. 2B.
Figure 2B:
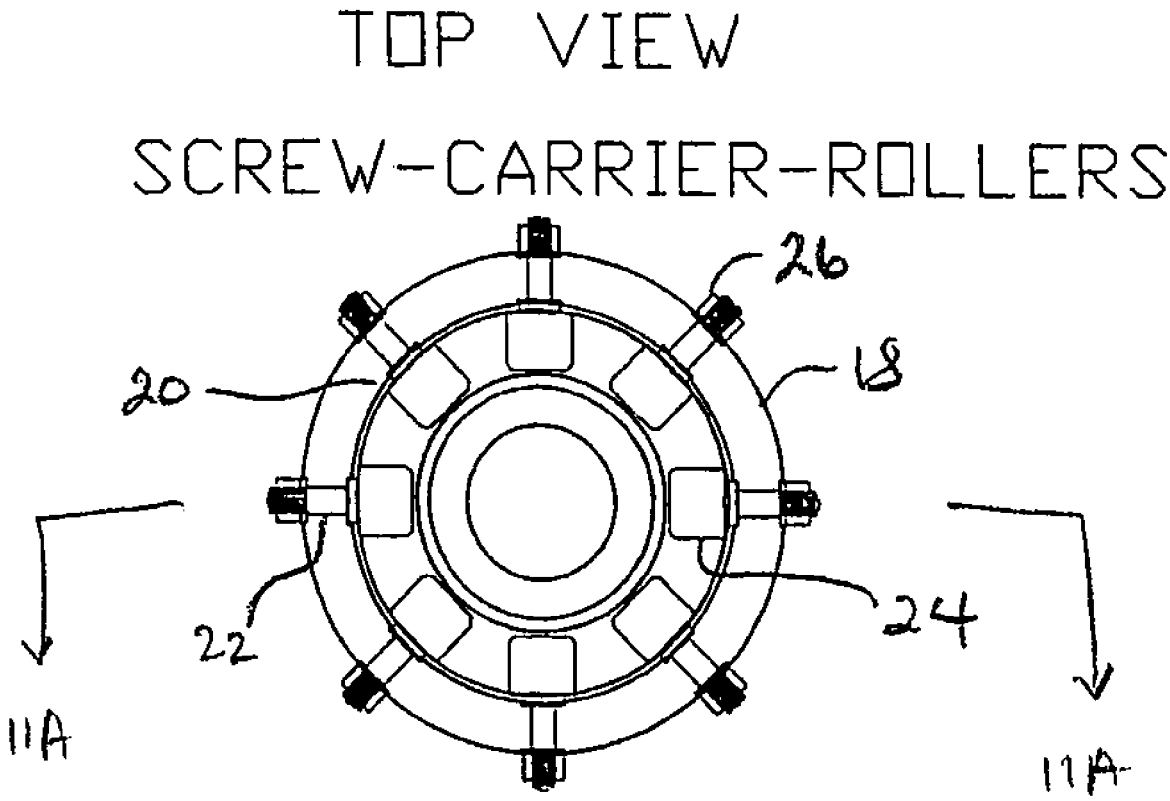
FIG. 2B is a cross-sectional view of the worm drive and collar, along one rotation of the helical groove of the worm drive.
Figure 3:
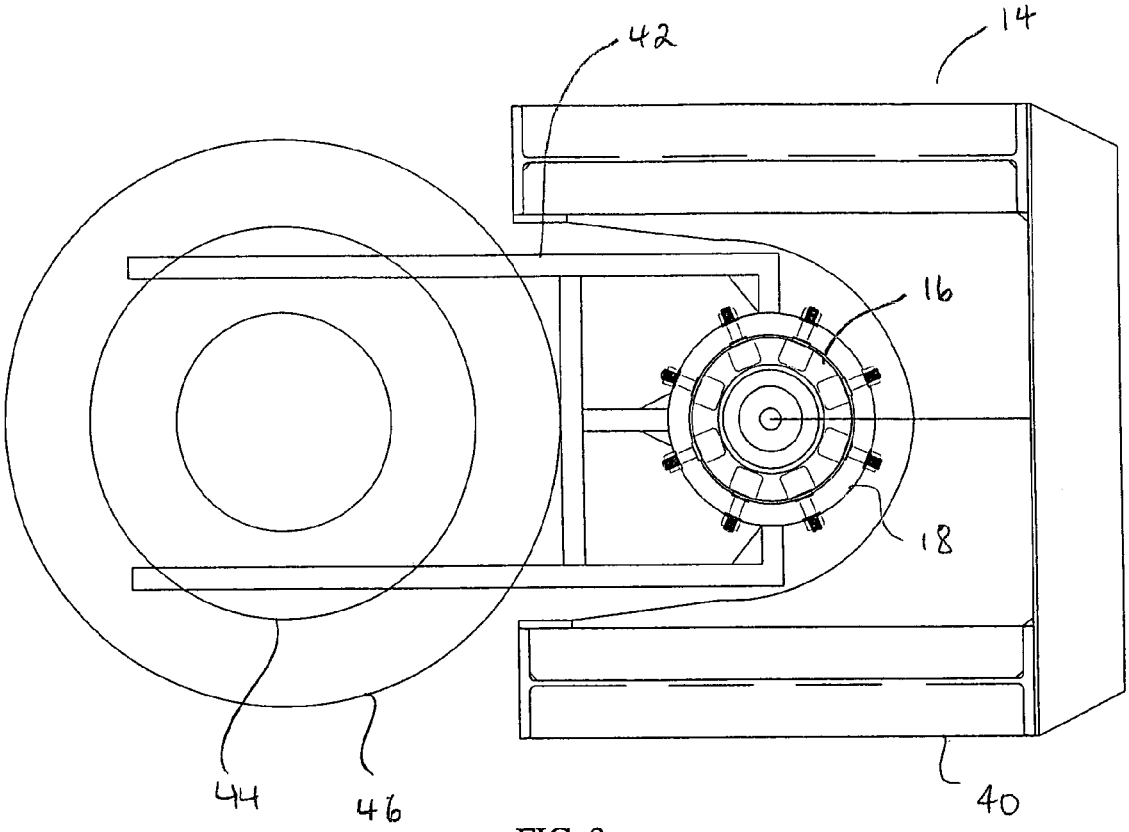
FIG. 3 is a top view of the mast and worm drive, showing the top drive assembly.

In one embodiment, the collar (18) may have a plurality of rollers (20) disposed internally which engage the worm drive. As shown in FIG. 2A and 2B, the rollers (20) may then be arrayed in a helical manner within the collar (18), matching the helical pitch of the worm drive. Each roller (20) may comprise a shaft (22) and a head (24) which is rotatably supported on the shaft by a suitable bearing set. The roller shaft (22) passes through an opening in the collar (18) and is secured by suitable means, such as a nut (26). A transverse cross-section along one helical turn of the worm drive is shown in FIG. 2B.

In a preferred embodiment, as shown in FIG. 2A, two adjacent rollers are inserted into a common keyhole opening having a central gap (28) large enough for the roller head (24) to pass through, and two lateral grooves (30) which are wider than the diameter of the roller shaft (22), but smaller than the roller head (24). The plane of the keyhole opening is of course pitched substantially at the same angle as the helical groove of the worm drive. Thus, an individual roller may be removed and inserted into the collar, while the collar is mounted on the worm drive, facilitating maintenance and repair of the rollers.

The mast (14) comprises a structural frame (40) which constrains and supports the worm drive (16). A cantilever frame (42) is attached to and extends outward from the collar (18). The cantilever frame (42) supports a block (44) to which is attached a top drive unit (46). In one embodiment, two collars (18) spaced apart on the worm drive are provided, increasing the load capacity of the worm drive.

Figure 4:
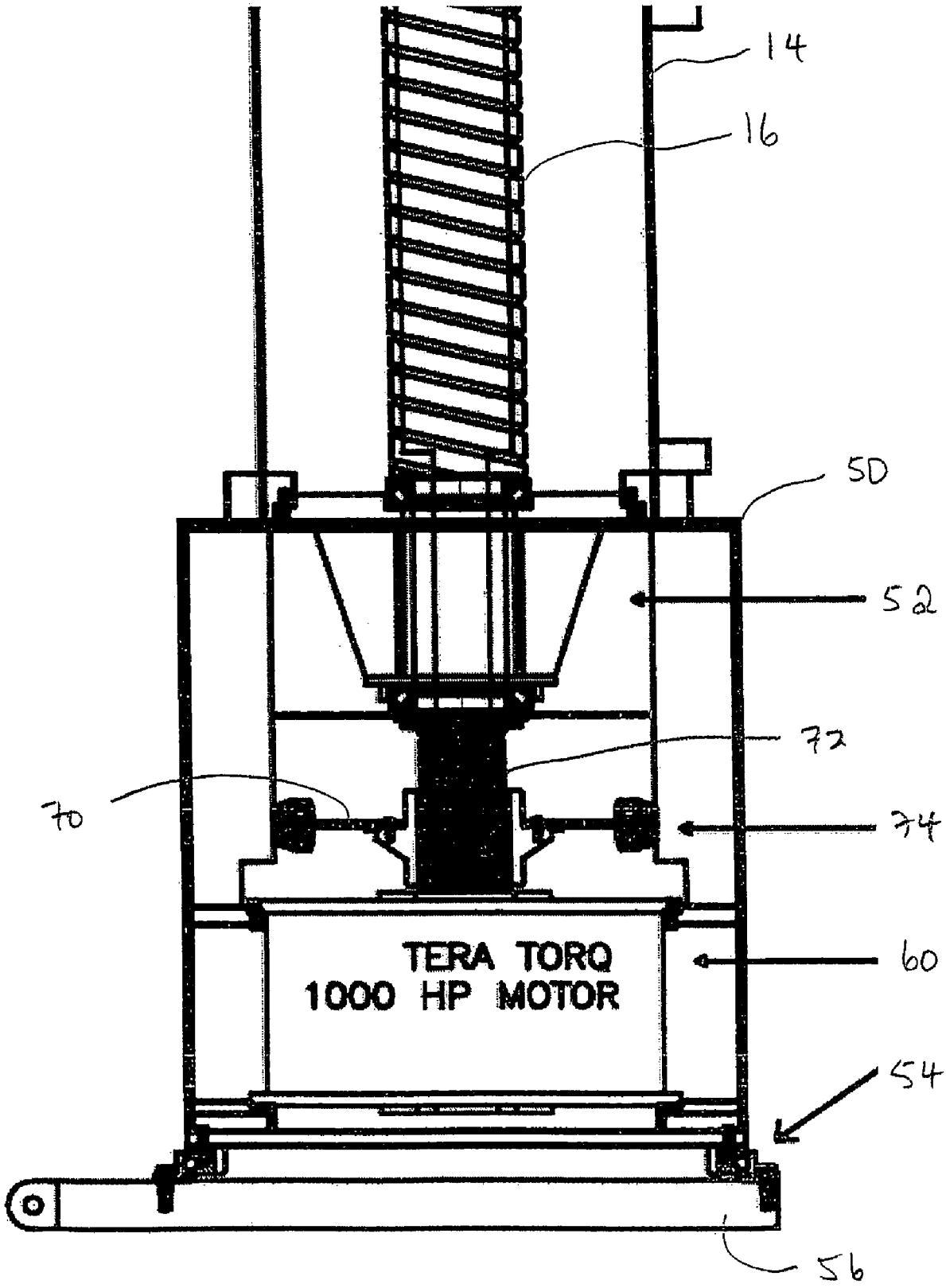
FIG. 4 is a view of a mast base.

As shown in FIG. 4, the mast (14) is supported by a mast base (50) which houses the bearing and motor assembly. In one embodiment, the worm drive (16) rests on a double locking bearing assembly (52) which supports and stabilizes the worm drive using thrust bearings of adequate capacity. In one embodiment, the worm drive (16) may be supported at its top end with suitable radial bearings (not shown) as well. In one embodiment, the mast base (50) may be rotatably attached to the substructure (12) so that it can rotate around the longitudinal axis of the worm drive (16). The mast base (50) may be mounted on suitable bearings (54) on mast support beam (56), which permits rotation of the mast about its longitudinal axis. Accordingly, once the rig is set in position, the top drive may be rotated around the longitudinal axis of the mast, permitting multiple mouse holes to be drilled. Once the mast is rotated to a desired position, means for fixing the mast in position may be provided, such as pins or clamps.

The worm drive (16) is driven by a suitable motor (60), such as electric motors well known in the art and commercially available. The motor may be directly coupled to the worm drive, as it is not necessary to drive the worm drive at high speeds. Rotational speeds of up to 600 rpm may still move the top drive vertically at a rate of up to 2.5 ft/s, depending on the pitch of the helical groove on the worm drive.

The mechanical advantage provided by the worm drive is proportional to the pitch of its helical groove. In any event, one skilled in the art will appreciate that there is no way to drop the top drive or drop the drill string to the floor with the top drive and blocks, short of catastrophic failure of the mast. Loss of power to the worm drive will simply result in the blocks and top drive being suspended in position or dropping very slowly. In one embodiment, a braking system may be provided but need not be a heavy duty braking system as a result. The braking system may comprise a disk-brake (70) attached to the driveshaft (72) disposed between the motor (60) and the worm drive (16). One or more brake calipers (74) are provided. The brake system may be operated as a fail-safe system, which activates the brake calipers (74) if power to the motor is lost. Alternatively, in one embodiment, the electric motor (60) may be used to dynamically brake the worm drive (16)

Figure 5A:
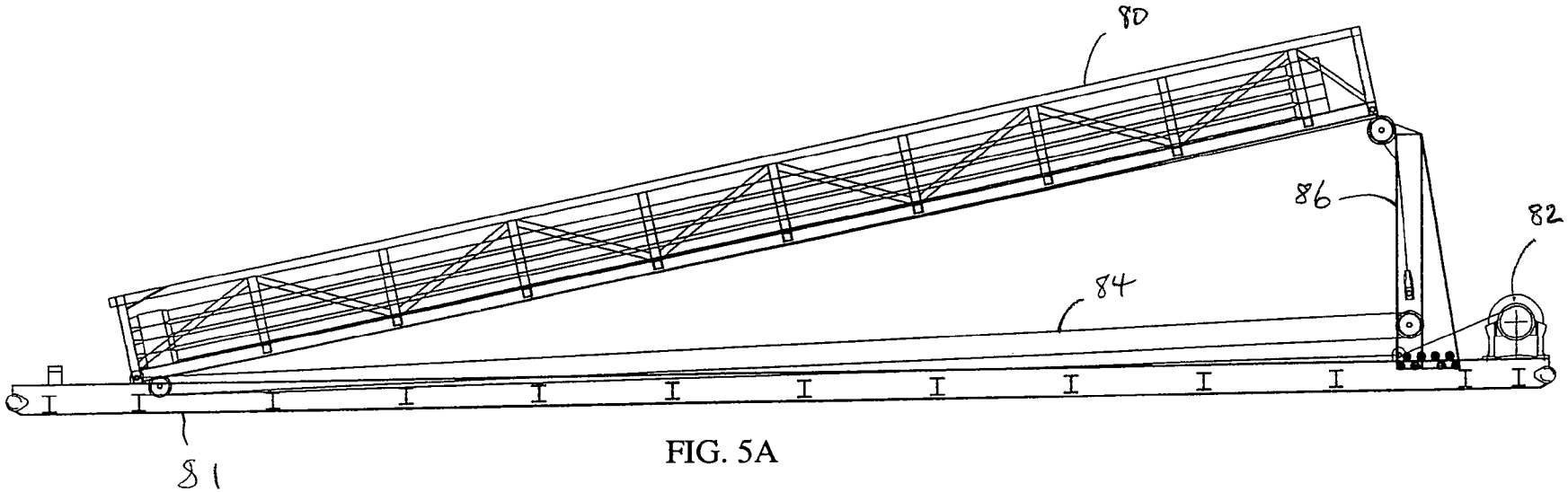
FIGS. 5A, 5B, and 5C shows a pipe tub in stages of erection.
Figure 5B:
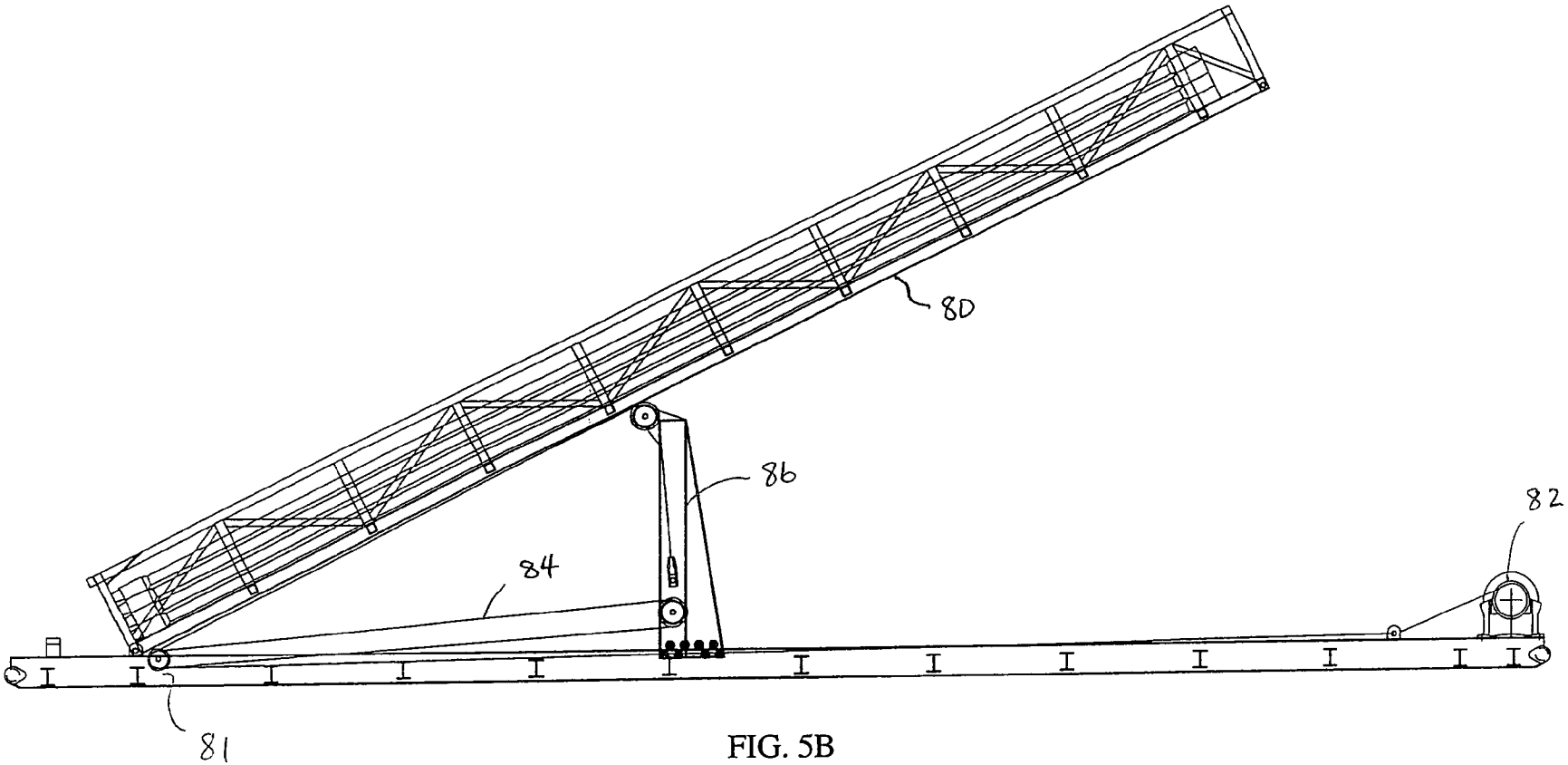
Figure 5C:
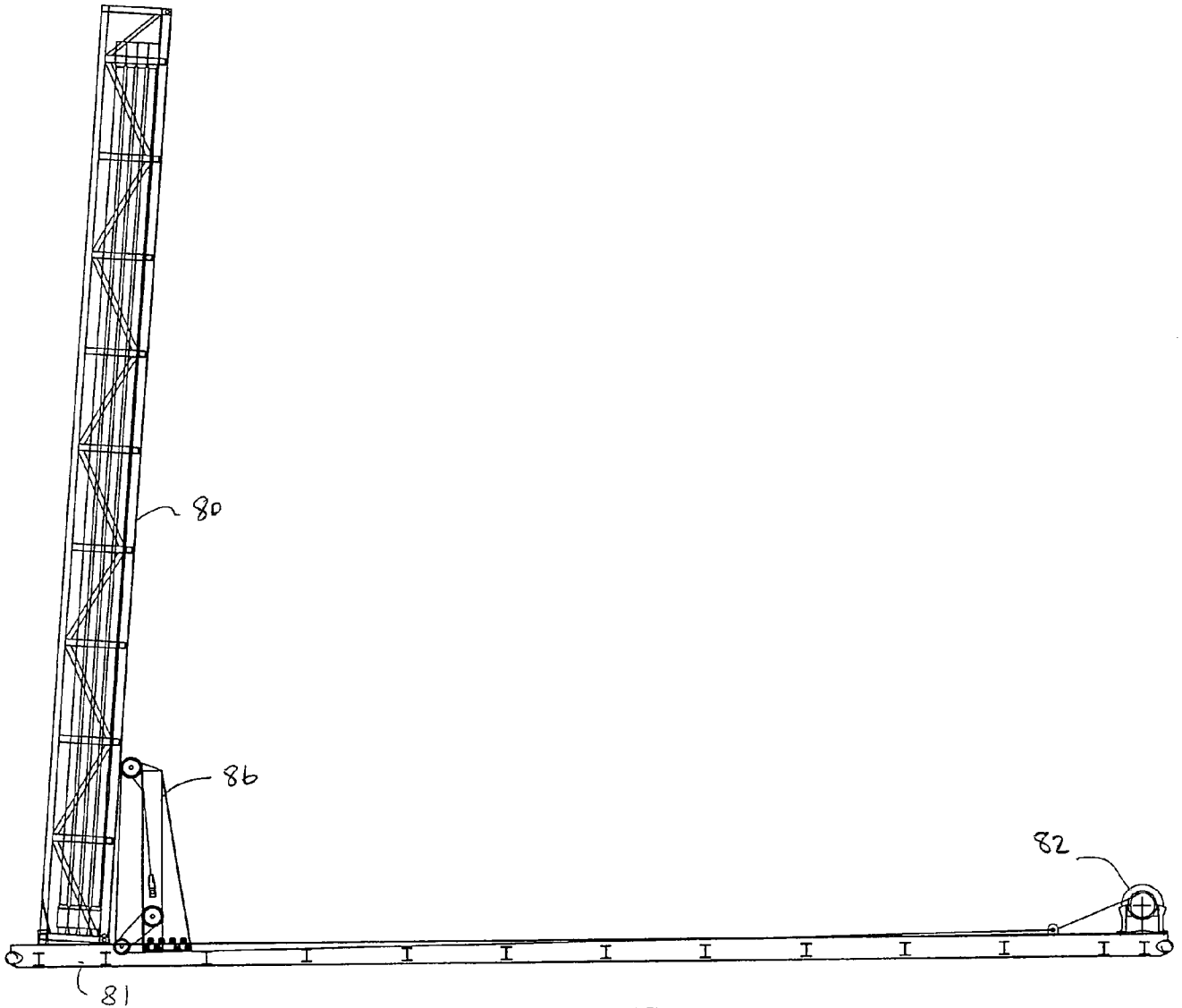

Drill pipe may be conventionally supplied. In a preferred embodiment, the pipe tub (80) may be moved from a horizontal position for transport, to a vertical position next to the mast, as shown in FIG. 1. FIGS. 5A, 5B, and 5C illustrates the pipe tub being raised by a winch (82), line (84) and pulley system. The winch (82) pulls a pipe tub stand (86) underneath the pipe tub (80) and towards the base of the pipe tub, which is pivotally attached to the pipe tub base (81). The raised pipe tub may be placed adjacent the mast during drilling or tripping procedures.

Figure 6:
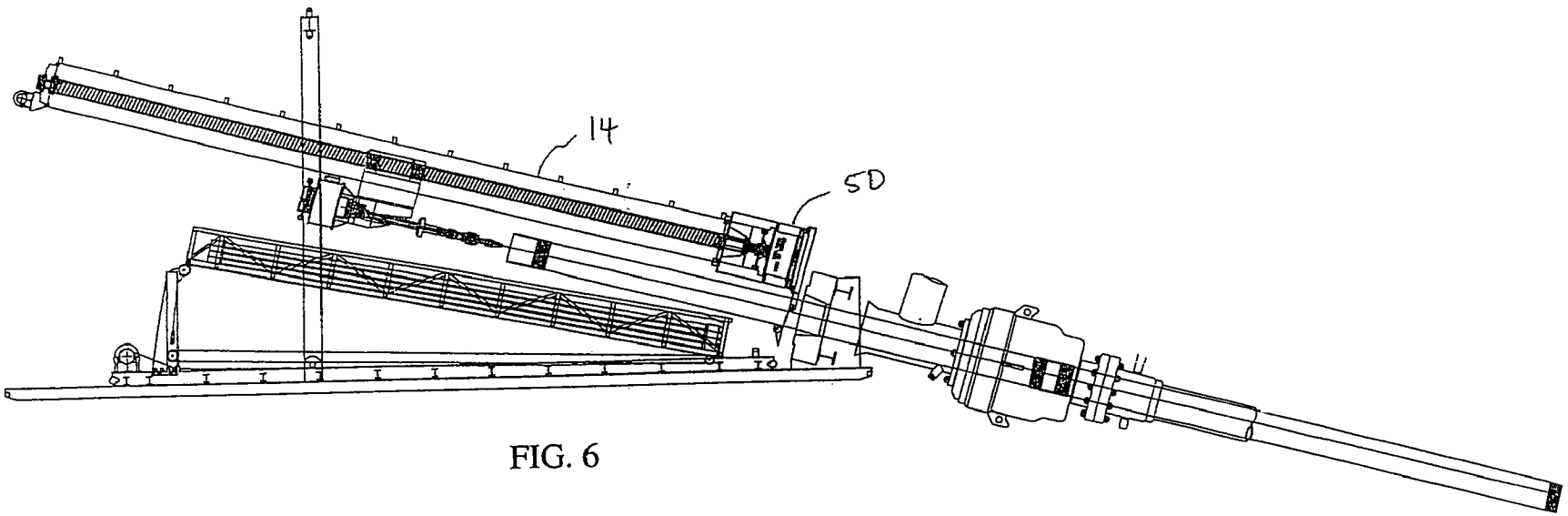
FIG. 6 shows a rig of the present invention in slant drilling configuration.

The mast (14) may be slanted to permit slant drilling applications. The mast base (50) may be mounted in such a manner that it can be pivoted to tilt the entire mast assembly, including the top drive and blocks. The mast may then be slanted at any desired angle, as may be seen in FIG. 6. Because the worm drive does not depend on gravity to weight the drill string, the rig may pull up full string weight or push down full string weight for slant drilling applications.

Figure 8:
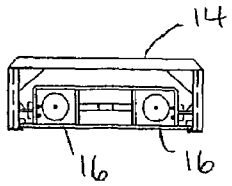
FIG. 8 shows a cross-section of FIG. 7.
Figure 7:
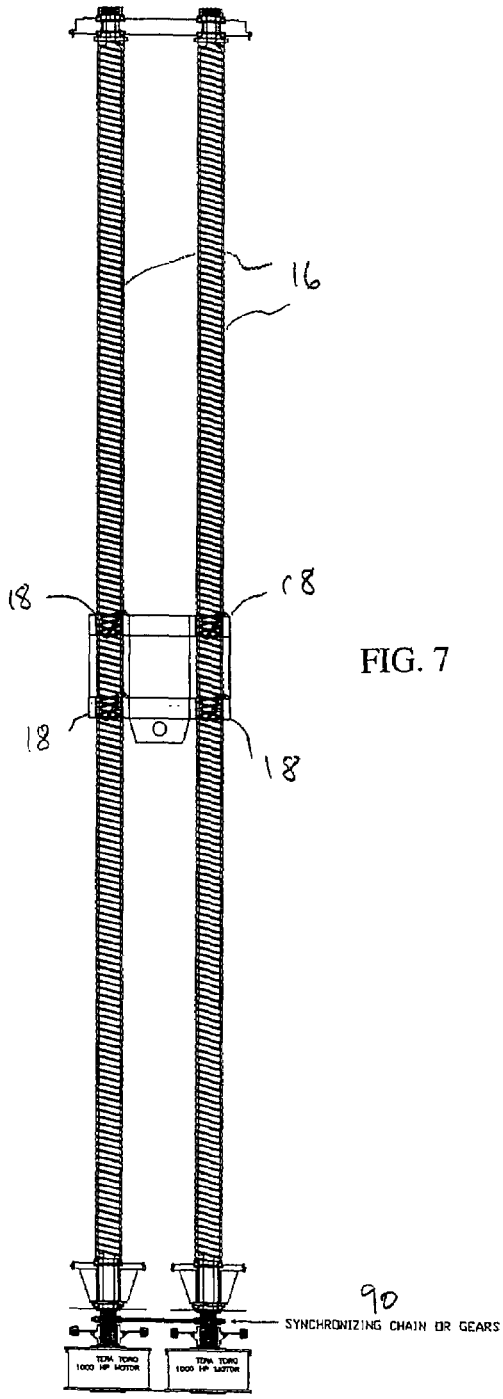
FIG. 7 shows a mast having a double worm drive.
Figure 10:
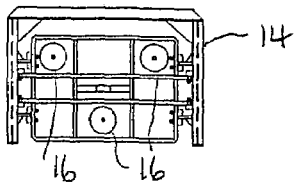
FIG. 10 shows a cross-section of FIG. 9.
Figure 9:
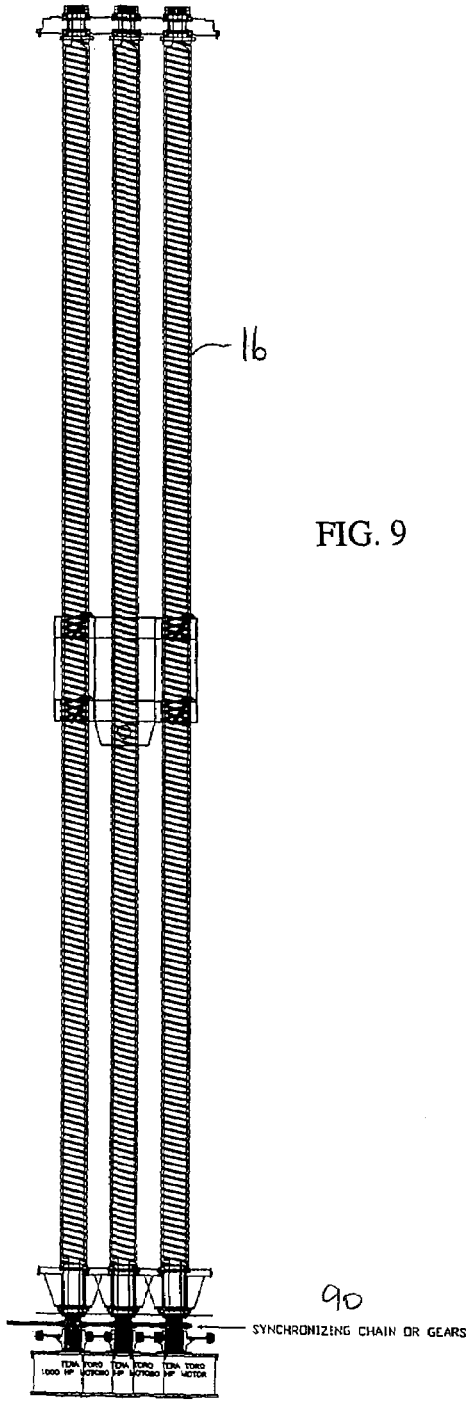
FIG. 9 shows a mast having a triple worm drive.

In alternative embodiments, multiple worm drives may permit increased load capacity. Double worm drives (FIG. 7) or triple worm drives (FIG. 8) may be implemented using the same principles of operation as described above. A synchronizing chain or gear set (90) may preferably be provided to ensure synchronized rotation of the multiple worm drives.

Figure 11:
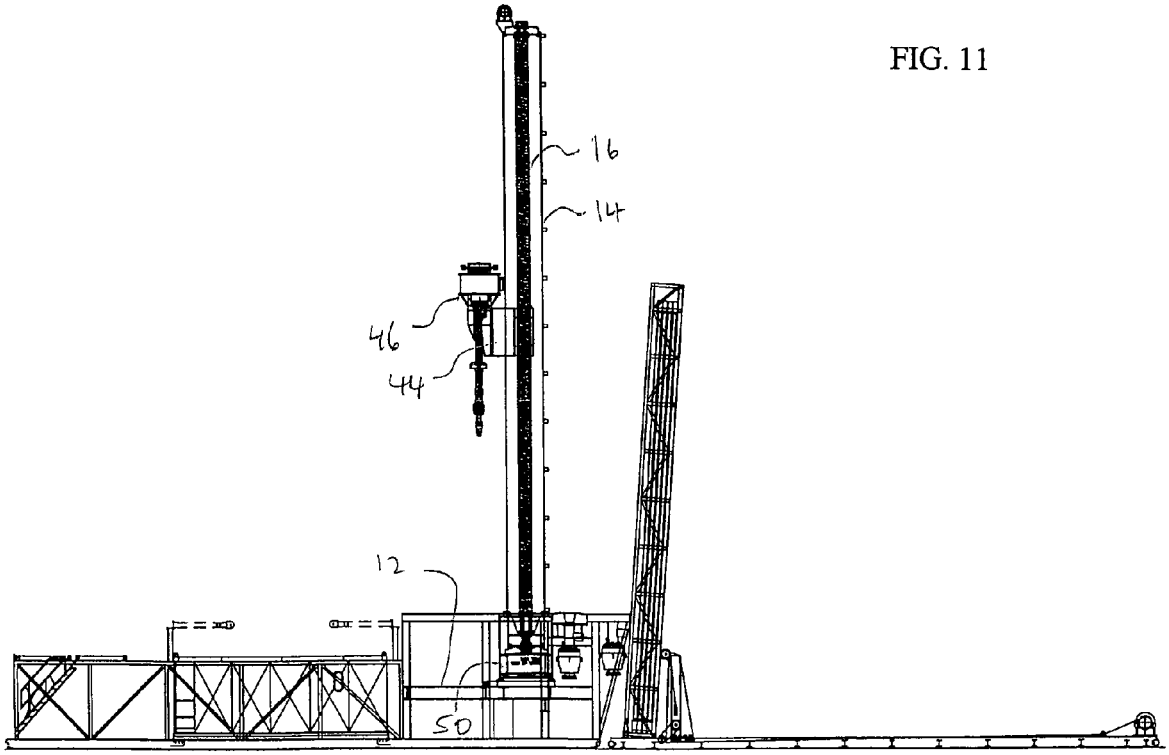
FIG. 11 shows an elevation view of one embodiment, where the mast has rotated the top drive out of alignment with the V-door.
Figure 12:
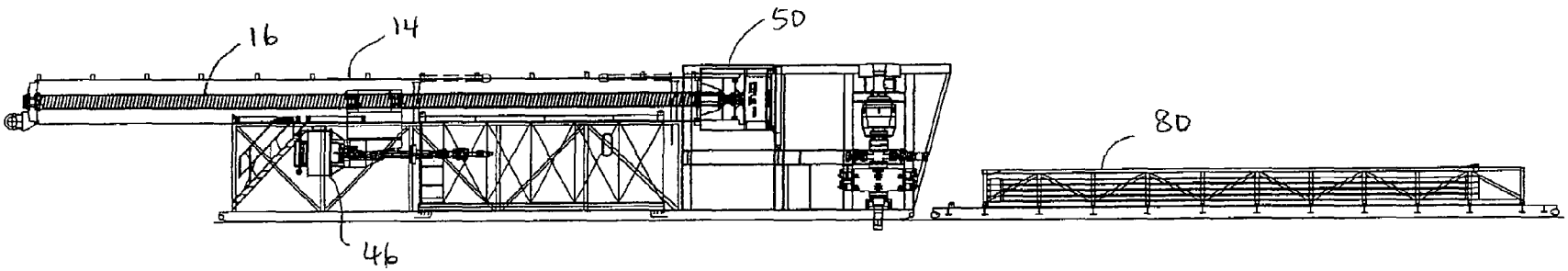
FIG. 12 shows the embodiment of FIG. 11, where the mast has been lowered into a transport position.

A rotatable mast (14) may permit the top drive may also be placed below the mast when the mast is lowered and rig is transported, thereby lowering the centre of gravity of the rig. As shown in FIG. 11, the mast is rotated away from alignment with the V-door. When the mast is laid down from this position, as shown in FIG. 12, the top drive and blocks are positioned within the rig substructure, and not above it.

What is claimed is:

1. A drilling or service rig comprising:

(a) a rig substructure having a mast base;

(b) a mast having at least one open side;

(c) an elongate worm drive defining a helical groove, disposed within the mast;

(d) at least one collar engaging the worm drive, the collar defining a plurality of keyhole openings and comprising a plurality of internal rollers for engaging the helical groove of the worm drive, wherein rotation of the worm drive causes longitudinal movement of the collar along the worm drive, and wherein each roller comprises a roller head and a roller shaft, and is inserted into the collar through a keyhole opening;

(e) a top drive assembly attached to the at least one collar and cantilevered from the collar out the open side of the mast; and (f) means for rotating the worm drive.

2. The rig of claim 1 wherein each keyhole opening has a central opening permitting passage of a roller head, and a narrowed portion smaller than the roller head.

3. The rig of claim 1 wherein the mast is rotatable around its longitudinal axis.

4. The rig of claim 1 wherein the mast is moveable between a vertical position and a substantially horizontal position, and may be fixed in any position therebetween.

5. The rig of claim 1 wherein the drive means comprises an electric motor.

6. The rig of claim 5 wherein the electric motor is directly coupled to the worm drive, without gear reduction or increase.

7. The rig of claim 1 further comprising a pipe tub assembly comprising a pipe tub skid, a pipe tub pivotally engaging the pipe tub skid at one end, a pipe tub stand which slidingly engages the pipe tub skid at one end and the pipe tub at another end, and a winch and pulley assembly for moving the pipe tub stand along the pipe tub skid, thereby moving the pipe tub between a near horizontal position to a substantially vertical position.

8. The rig of claim 1 further comprising a brake assembly comprising a brake disk attached to the worm drive, and at least one pair of brake calipers operatively engaging the brake disk.

9. The rig of claim 1 wherein the mast includes two or more worm drives, comprising means for synchronizing the two or more worm drives.

10. The rig of claim 9 wherein the mast includes three worm drives.

11. The rig of claim 9 wherein each worm drive actuates two collars, wherein the top drive assembly is attached to both collars.

12. The rig of claim 2 wherein each keyhole opening has two narrowed portions and is associated with two adjacent rollers.

* * * * *